US005545934A

United States Patent [19]

Reddy et al.

[11] Patent Number: 5,545,934

[45] Date of Patent: Aug. 13, 1996

[54] VOLTAGE CLAMP CIRCUIT

[75] Inventors: Chitranjan N. Reddy, Milpitas; Kevin P. Quinn, Los Gatos, both of Calif.

[73] Assignee: Alliance Semiconductor Corporation, San Jose, Calif.

[21] Appl. No.: 361,735

[22] Filed: Dec. 22, 1994

[51] Int. Cl.[6] ..... G05F 1/00

[52] U.S. Cl. ..... 307/130; 307/116; 327/306; 327/309; 327/318; 327/321; 327/322; 323/282; 237/355; 326/68

[58] Field of Search ..... 307/130, 116; 327/321, 322, 318, 309, 306; 237/355; 326/68; 323/282

[56] References Cited

U.S. PATENT DOCUMENTS

| | | | |
|---|---|---|---|
| 4,347,447 | 8/1982 | Proebsting | 307/548 |
| 4,945,262 | 7/1990 | Piasecki | 307/451 |
| 5,206,553 | 4/1993 | Imai et al. | 307/540 |
| 5,420,526 | 5/1995 | Fenseh | 326/30 |

OTHER PUBLICATIONS

Lance A. Glasser et al., "The Design and Analysis of VLSI Circuits", Addison Wesley Publishing Company, pp. 301–308.

*Primary Examiner*—William M. Shoop, Jr.
*Assistant Examiner*—Albert W. Paladini
*Attorney, Agent, or Firm*—Limbach & Limbach L.L.P.

[57] ABSTRACT

A clamping circuit for clamping a circuit node during an initial circuit powerup interval includes a switching circuit and a switching control circuit. The switching circuit is an N-MOSFET with its drain and source terminals connected to circuit ground and the subject node sought to be clamped, respectively, and its gate terminal connected to the switching control circuit. The switching control circuit includes a number of N-MOSFETs which are interconnected in such a manner as to receive the power supply voltage and generate a switching signal which turns the switching circuit N-MOSFET on during an initial circuit powerup interval to clamp the subject node and then off after the power supply has reached a preselected minimum value. Upon initial circuit powerup, the switching control circuit self-triggers itself to turn the switching circuit on and clamp the subject node at ground potential. After the power supply has reached a preselected minimum value, the switching control circuit self-triggers itself again to turn the switching circuit off and thereby release the subject node from any clamping action. This clamping circuit is useful for temporarily clamping a VBB pad driven by a charge pump for back-biasing an integrated circuit substrate to prevent circuit latchup during initial circuit powerup.

20 Claims, 2 Drawing Sheets

VOLTAGE CLAMP CIRCUIT

BACKGROUND OF THE INVENTION

1. Field of the Invention

The present invention relates to voltage clamping circuits, and in particular, to voltage clamping circuits which are self-triggered in accordance with the amplitude of its power supply voltage.

2. Description of the Related Art

As the scale of integration has increased in integrated circuits (ICs) containing N-channel metal-oxide-semiconductor field effect transistors (N-MOSFETs), such circuits have become increasingly prone to latching up during initial circuit powerup sequences. As is well known in the art, parasitic effects of the various semiconductor fabrication processes (e.g., parasitic bipolar junction transistors) can tend to cause the MOSFET circuitry to latch up upon the initial application of its power supply voltage.

One common technique to prevent circuit latchup from occurring has been to apply a biasing voltage to the underlying substrate of the integrated circuit which is negative with respect to the circuit reference, or ground, node. This negative substrate bias, commonly referred to as a "back bias voltage" (VBB), is frequently generated by a charge pump circuit driven by an oscillator. Referring to FIG. 1, an oscillator drives a charge pump with an AC input signal. The charge pump converts the low amplitude AC input signal to a pumped-up DC voltage which is applied to a VBB pad which is connected to the underlying substrate of the IC. (Such back biasing of an IC substrate is well known in the art. See, for example, L. A. Glasser and D. W. Dobberpuhl, "The Design and Analysis of VLSI Circuits," Addison-Wesley, 1985, pp. 301-08.)

In theory, the use of an oscillator and charge pump to provide a substrate back bias can prevent circuit latchup during the initial stages of powerup. However, in practice, problems can develop. Since the oscillator and charge pump are also powered by the IC power supply (VCC), they too are subject to the problems caused by an initially low power supply voltage during the initial stages of powerup. In other words, during the initial stages of powerup, the power supply voltage VCC is at a low, albeit increasing, voltage and the oscillator may not oscillate at a high enough frequency to provide sufficient drive to the charge pump. This can prevent a sufficiently high back bias VBB from being generated in time while, in the meantime, transistor leakage or substrate coupling can cause the IC substrate to become forward biased, thereby resulting in circuit latchup.

Accordingly, it would be desirable to have a circuit which prevents forward biasing of the IC substrate until such time as the back bias oscillator and charge pump are sufficiently operational to supply the necessary substrate back bias voltage VBB.

SUMMARY OF THE INVENTION

An apparatus including a voltage clamp circuit for selectively clamping a circuit node in accordance with one embodiment of the present invention includes first and second nodes, an activation control circuit and a switch circuit. The first node is for operating at a selectable voltage while the second node is for operating at a clamp voltage. The activation circuit is for receiving a supply voltage having a magnitude with first and second values and a third value therebetween and in response thereto providing a switch signal in one of first and second signal states. The switch circuit is coupled to the activation circuit and between the first and second nodes and is for receiving the switch signal, coupling the first node to the second node in response to the first signal state so as to clamp the selectable voltage at the clamp voltage and decoupling the first node from the second node in response to the second signal state. In a preferred embodiment of the present invention, further included is a control circuit coupled to the activation circuit for receiving the supply voltage and in response thereto providing a control signal to the activation circuit. In response to the supply voltage and control signal, the activation circuit provides the switch signal with the first and second signal states.

These and other features and advantages of the present invention will be understood upon consideration of the following detailed description of the invention and the accompanying drawings.

DETAILED DESCRIPTION OF THE INVENTION

Figure 2:
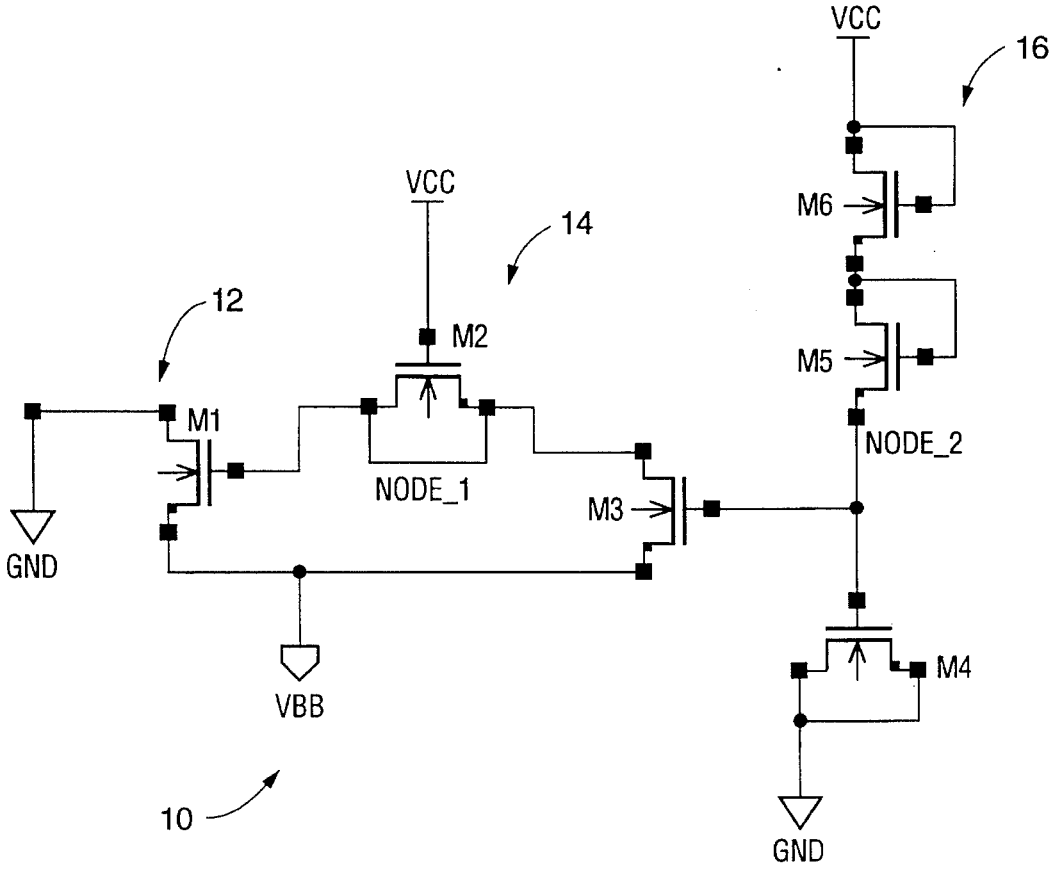
FIG. 2 is a schematic diagram of a voltage clamp circuit in accordance with one embodiment of the present invention.

Referring to FIG. 2, a voltage clamp circuit 10 in accordance with one embodiment of the present invention includes a switch circuit 12 and an activation circuit, or switch controller, having two stages 14, 16.

The switch circuit 12 includes an N-MOSFET M1 with its drain terminal connected to the VBB pad and its source terminal connected to circuit ground GND.

The first stage 14 of the switch controller includes N-MOSFETs M2 and M3 (totem-pole-coupled between the gate terminal of transistor M1 and the VBB pad). Transistor M2 acts as a capacitor, with its gate terminal connected to the power supply VCC and its drain and source terminals shorted together and connected to the gate terminal of transistor M1 and to the drain terminal of transistor M3 (Node 1). The source terminal of transistor M3 is connected to the VBB pad.

The second stage 16 of the switch controller includes N-MOSFETs M4, M5 and M6. M4 also acts as a capacitor, with its gate terminal connected to the gate terminal of transistor M3 and its drain and source terminals shorted together and connected to circuit ground GND. Transistors M5 and M6 are totem-pole-coupled between the power supply VCC and the gate terminals of transistors M3 and M4 (Node 2), with their gate terminals connected to their respective drain terminals.

During initial circuit powerup, as the power supply voltage VCC increases from zero (e.g., "first value") to its full value (e.g., "second value" 5 volts), the voltage at Node 1 begins to increase due to the capacitive coupling of the capacitor formed by transistor M2. When the voltage at Node 1 reaches a "first state" by becoming sufficiently high (equal to or greater than the threshold voltage $V_T$ for transistor M1), transistor M1 turns on and thereby couples the VBB pad to circuit ground GND through its drain and source terminals and now-conductive channel. This causes the voltage present at the VBB pad to be clamped at circuit ground GND potential. Up to now, transistor M3 remains turned off because of a low potential at Node 2 due to the initially low value of the power supply voltage VCC.

Figure 1:
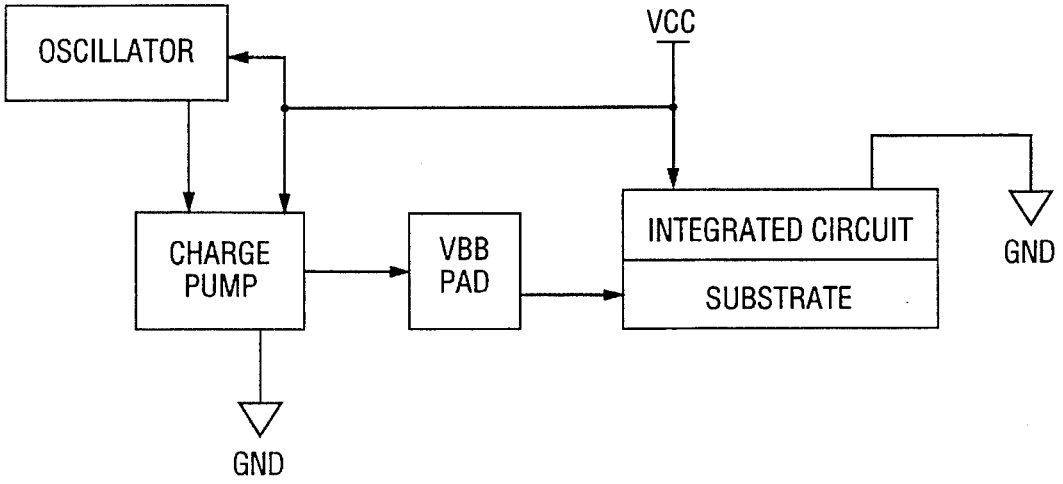
FIG. 1 (PRIOR ART)
FIG. 1 is a functional block diagram of a conventional biasing circuit used for providing a back bias voltage to the underlying substrate of an integrated circuit.

As the power supply voltage VCC continues to increase, transistors M5 and M6 will begin to turn on. Once the power supply voltage VCC reaches the equivalent of two transistor threshold voltage drops above circuit ground GND, the voltage at Node 2 will begin to increase. As the power supply voltage VCC increases further (e.g., to a "third value"), the voltage at Node 2 (i.e., the voltage across the capacitor formed by transistor M4) becomes large enough to turn on transistor M3. Once transistor M3 turns on, Node 1 becomes coupled to circuit ground GND through the drain and source terminals and conductive channels of transistors M3 and M1. This results in the charges at Node 1 and the VBB pad discharging to circuit ground GND through transistors M3 and M1. In turn, due to this "second state" of the voltage at Node 1, this causes transistor M1 to turn off, thereby isolating the VBB pad from circuit ground GND and allowing it to become negative in accordance with a negative potential applied by a charge pump (not shown), as discussed above for FIG. 1.

As the power supply voltage VCC continues to increase, the voltage at Node 2 also increases while remaining two transistor threshold voltage drops below VCC. This causes transistor M3 to remain on, thereby maintaining the coupling of Node 1 to the VBB pad. This results in the gate terminal of transistor M1 becoming negative with respect to its source terminal at circuit ground GND (due to the negative bias applied to the VBB pad by the charge pump). Hence, once the power supply voltage VCC has reached its full potential, the VBB pad, now negative in accordance with its applied charge pump voltage, is isolated from circuit ground GND by transistor M1 and, due to the above-described operation of the voltage clamp circuit 10, circuit latchup has been prevented.

Figure 3:
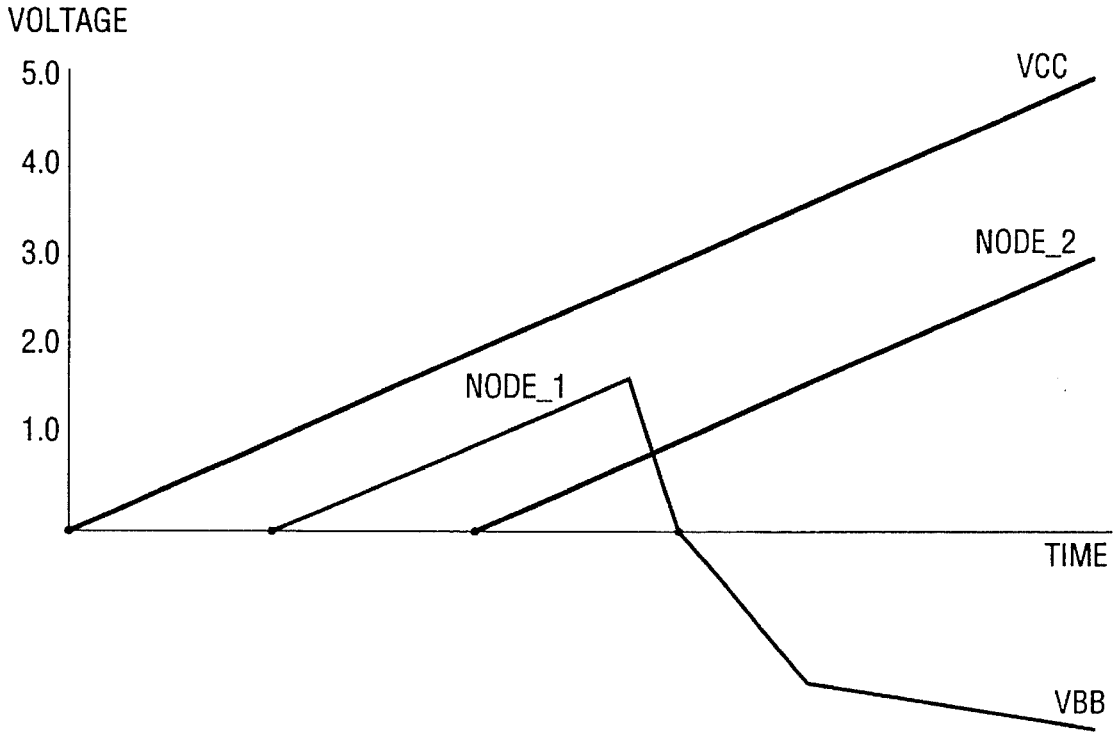
FIG. 3 is a voltage versus time plot of selected node voltages for the circuit of FIG. 2.

Referring to FIG. 3, the above-discussed action of the voltage clamp circuit 10 can be better understood. In accordance with the foregoing discussion, the voltages at Nodes 1 and 2 increase with VCC, with the voltage at Node 1 being in its "first state," but are delayed in time. Once the power supply voltage VCC has reached the equivalent of three transistor threshold voltage drops above circuit ground GND, transistors M6, M5 and M3 are all turned on (due to transistor M1 being turned on already). As discussed above, this causes the voltage present at Node 1 to enter its "second state" and fall as Node 1 discharges through transistors M3 and M1 to circuit ground GND. As further discussed above, with transistor M3 turned on, Node 1 is coupled to the VBB pad and its voltage follows that of the VBB pad. Meanwhile, the voltage at Node 2 continues to increase with VCC.

Various other modifications and alterations in the structure and method of operation of this invention will be apparent to those skilled in the art without departing from the scope and spirit of the invention. Although the invention has been described in connection with specific embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a voltage clamp circuit for selectively clamping a circuit node during a circuit powerup interval, said voltage clamp circuit comprising:

a first node for operating at a selectable voltage;

a second node for operating at a clamp voltage;

an activation circuit for receiving a supply voltage having an increasing magnitude with first and second values and a third value therebetween and in response thereto providing a switch signal in one of first and second signal states; and a switch circuit, coupled to said activation circuit and between said first and second nodes, for receiving said switch signal, coupling said first node to said second node in response to said first signal state to clamp said selectable voltage at said clamp voltage and decoupling said first node from said second node in response to said second signal state.

2. An apparatus as recited in claim 1, wherein said activation circuit comprises a plurality of MOSFETs totem-pole-coupled between said switch circuit and said first node.

3. An apparatus as recited in claim 1, wherein said activation circuit further receives a control signal and in response to said received supply voltage and control signal provides said switch signal with said first and second signal states.

4. An apparatus as recited in claim 3, wherein said control signal causes said switch signal to switch between said first and second signal states.

5. An apparatus as recited in claim 1, wherein said switch circuit comprises a MOSFET with drain and source terminals coupled between said first and second nodes and a gate terminal for receiving said switch signal.

6. An apparatus as recited in claim 1, wherein said switch signal is in said first signal state when said supply voltage magnitude is between said first and third values, said switch signal is in said second signal state when said supply voltage magnitude is between said second and third values, and said first and second supply voltage magnitude values comprise initial and final supply voltage magnitude values, respectively.

7. An apparatus as recited in claim 1, further comprising a control circuit, coupled to said activation circuit, for receiving said supply voltage and in response thereto providing a control signal to said activation circuit, wherein said activation circuit provides said switch signal with said first and second signal states in response to said received supply voltage and said control signal.

8. An apparatus as recited in claim 7, wherein said control signal causes said switch signal to switch between said first and second signal states.

9. An apparatus as recited in claim 7, wherein said activation circuit comprises a plurality of MOSFETs, totem-pole-coupled between said switch circuit and said first node.

10. An apparatus as recited in claim 7, wherein said switch circuit comprises a MOSFET with drain and source terminals coupled between said first and second nodes and a gate terminal for receiving said switch signal.

11. An apparatus as recited in claim 7, further comprising a supply node for operating at said supply voltage, wherein said control circuit comprises a plurality of MOSFETs totem-pole-coupled between said supply node and said activation circuit.

12. An apparatus as recited in claim 7, wherein said switch signal is in said first signal state when said supply voltage magnitude is between said first and third values, and wherein said switch signal is in said second signal state when said supply voltage magnitude is between said second and third values, and further wherein said first and second supply voltage magnitude values comprise initial and final supply voltage magnitude values, respectively.

13. An apparatus including a voltage clamp circuit for clamping a circuit node during an initial circuit powerup interval, said voltage clamp circuit comprising:

a supply node for operating at a supply voltage having an increasing magnitude with initial and final values and an intermediate value therebetween;

a reference node for operating at a reference voltage;

a clamp node for operating at a selectable voltage;

a first control circuit, coupled between said supply and reference nodes, for receiving said supply voltage and in response thereto providing a first control signal;

a second control circuit, coupled to said supply node, said clamp node and said first control circuit, for receiving said supply voltage and said first control signal and in response thereto providing a second control signal with first and second signal states, wherein said second control signal is in said first signal state when said supply voltage magnitude is between said initial and intermediate values, and wherein said second control signal is in said second signal state when said supply voltage magnitude is between said intermediate and final values; and a switch circuit, coupled to said second control circuit and between said reference and clamp nodes, for receiving said second control signal, coupling said clamp node to said reference node in response to said first signal state to clamp said selectable voltage at said reference voltage and decoupling said clamp node from said reference node in response to said second signal state.

14. An apparatus as recited in claim 13, wherein said first control circuit comprises a plurality of totem-pole-coupled MOSFETs coupled between said supply node and said second control circuit.

15. An apparatus as recited in claim 13, wherein said second control circuit comprises a plurality of MOSFETs, coupled to said supply node and totem-pole-coupled between said switch circuit and said clamp node.

16. An apparatus as recited in claim 13, wherein said switch circuit comprises a MOSFET with drain and source terminals coupled between said reference and clamp nodes and a gate terminal for receiving said second control signal.

17. A method of selectively clamping a circuit node during a circuit powerup interval, said method comprising the steps of:

operating a first node at a selectable voltage;

operating a second node at a clamp voltage;

receiving a supply voltage having an increasing magnitude with first and second values and a third value therebetween and in response thereto providing a switch signal in one of first and second signal states;

coupling said first node to said second node in response to said first signal state and clamping said selectable voltage at said clamp voltage; and decoupling said first node from said second node in response to said second signal state.

18. A method as recited in claim 17, wherein said step of receiving a supply voltage having a magnitude with first and second values and a third value therebetween and in response thereto providing a switch signal in one of first and second signal states comprises receiving said supply voltage and a control signal and in accordance therewith providing said switch signal with said first and second signal states.

19. A method as recited in claim 18, further comprising the step of switching said switch signal between said first and second signal states in response to said control signal.

20. A method as recited in claim 17, further comprising the steps of:

receiving said supply voltage and in response thereto providing a control signal; and switching said switch signal between said first and second signal states in response to said control signal.

* * * * *